US010315338B2

(12) United States Patent
Wung

(10) Patent No.: US 10,315,338 B2
(45) Date of Patent: Jun. 11, 2019

(54) FOLDABLE WATER TRAY FOR TILE CUTTER

(71) Applicant: Rexon Industrial Corp., Ltd., Taichung (TW)

(72) Inventor: Chun Ti Wung, Taichung (TW)

(73) Assignee: Rexon Industrial Corp., Ltd., Taichung (TW)

( * ) Notice: Subject to any disclaimer, the term of this patent is extended or adjusted under 35 U.S.C. 154(b) by 281 days.

(21) Appl. No.: 15/459,055

(22) Filed: Mar. 15, 2017

(65) Prior Publication Data

US 2017/0266845 A1 Sep. 21, 2017

(30) Foreign Application Priority Data

Mar. 18, 2016 (TW) ..... 105108471 A

(51) Int. Cl.
*B28D 7/02* (2006.01)
*B28D 1/04* (2006.01)

(52) U.S. Cl.
CPC ..... *B28D 7/02* (2013.01); *B28D 1/047* (2013.01)

(58) Field of Classification Search
CPC ..... B28D 1/025; B28D 7/02; B28D 1/047; B28D 1/04; B28D 7/04; B23D 59/02; B23D 47/025; Y10T 83/283; Y10T 83/7705
USPC ..... 220/571
See application file for complete search history.

(56) References Cited

U.S. PATENT DOCUMENTS 5,676,124 A * 10/1997 Lee ..... B28D 1/047 125/13.01
7,028,683 B1 * 4/2006 Chen ..... B28D 1/04 125/13.01
9,016,180 B2 * 4/2015 Sheddy ..... B23D 45/02 83/529
10,070,744 B2 * 9/2018 Schiff ..... A47G 23/0625
2003/0051720 A1 * 3/2003 Bradfield ..... B23D 47/025 125/12
2004/0134324 A1 * 7/2004 Sheddy ..... B23D 45/02 83/581
2006/0011191 A1 * 1/2006 Vavricek ..... B23D 47/025 125/13.01
2006/0218803 A1 * 10/2006 Zhang ..... B23D 45/024 30/371
2009/0266350 A1 * 10/2009 Zhang ..... B23D 59/007 125/13.01
2014/0352680 A1 * 12/2014 Chen ..... B28D 1/047 125/13.01
2015/0367530 A1 * 12/2015 Vikholm ..... B28D 7/02 125/13.01
2016/0207223 A1 * 7/2016 Schlough ..... B28D 7/043

FOREIGN PATENT DOCUMENTS

DE 202014101170 U1 * 6/2014 ..... B28D 1/047

* cited by examiner

*Primary Examiner* — Shawn M Braden
(74) *Attorney, Agent, or Firm* — Bacon & Thomas, PLLC

(57) ABSTRACT

A foldable water tray used in a tile cutter includes a water tank having a water chamber, a first tray movable in and out of the water chamber of the water tank between an application position and a storage position, and a second tray pivotally connected to the first tray and biasable relative to the first tray between an extended position where the second tray defines with the first tray a predetermined contained angle and a collapsed position where the second tray covers the first tray and can be moved with the first tray between the application position and the storage position.

5 Claims, 9 Drawing Sheets

FOLDABLE WATER TRAY FOR TILE CUTTER

BACKGROUND OF THE INVENTION

1. Field of the Invention

The present invention relates to tile cutter technology, and more particularly, to a foldable water tray used in a tile cutter.

2. Description of the Related Art

Since tiles are brittle, regular cutting tools cannot be used for cutting tiles. For cutting tiles, a specially designed tile cutter must be used. When operating a tile cutter to cut a tile, it is necessary to spray water over the tile being cut. Although spraying water over the tile being cut can, on the one hand, cool the temperature of the cutter blade, on the other hand, the spraying of water wets dust to stop dust from flying in the air, avoiding the user from excessive inhalation of dust which causes discomfort.

In order to prevent water from splashing during the cutting operation, a water retaining shell can be provided at the back side relative to the cutter blade. However, according to the conventional design, this water retaining shell is not collapsible, and thus, when the tile cutter is not used, the water retaining shell still occupies a large amount of storage space.

SUMMARY OF THE INVENTION

The present invention has been developed in view of the above circumstances. It is one of the main objects of the present invention to provide a foldable water tray for a tile cutter, which is collapsible and able to be accommodated to save space when not used.

To achieve this and other objects of the present invention, a foldable water tray comprises a water tank, a first tray and a second tray. The water tank contains therein a water chamber. The first tray is mounted at one end of the water tank, and movable relative to the water tank between an application position where the first tray is disposed outside the water chamber and a storage position where the first tray is disposed inside the water chamber. Further, the first tray comprises a first water retaining surface. The second tray is pivotally connected to the first tray, and biasable relative to the first tray between an extended position and a collapsed position. The second tray comprises a second water retaining surface. When the second tray is disposed in the extended position, the second water retaining surface defines with the first water retaining surface of the first tray a predetermined contained angle so that the first tray and the second tray can jointly provide a water retaining effect. When the second tray is disposed in the collapsed position, the second water retaining surface of the second tray covers the first water retaining surface of the first tray so that the second tray can be moved with the first tray between the application position and the storage position.

Preferably, the first tray further comprises at least one slot cut through the first water retaining surface, and at least one elastic protruding portion located at the first water retaining surface and respectively disposed to face toward the at least one slot. Preferably, the second tray further comprises at least one bearing protrusion located at a bottom side thereof opposite to the second water retaining surface and adapted for abutment against the at least one elastic protruding portion of the first tray to support the second tray in the extended position. The elastic design of the at least one elastic protruding portion of the first tray can create a certain space for allowing the second tray to be biased downwards so that the workpiece can be smoothly cut regardless of the interference of the second tray.

Preferably, the water tank comprises a first stop flange located in the water chamber. Preferably, the first tray further comprises a second stop flange located at one end thereof for engagement with the first stop flange of the water to hold the first tray in the application position and preventing separation of the first tray from the water tank.

Preferably, the first water retaining surface of the first tray slopes downwards toward the water chamber of the water tank so that the first water retaining surface of the first tray can effectively guide water into the water chamber of the water tank.

Other advantages and features of the present invention will be fully understood by reference to the following specification in conjunction with the accompanying drawings, in which like reference signs denote like components of structure.

DETAILED DESCRIPTION OF THE INVENTION

Figure 1:
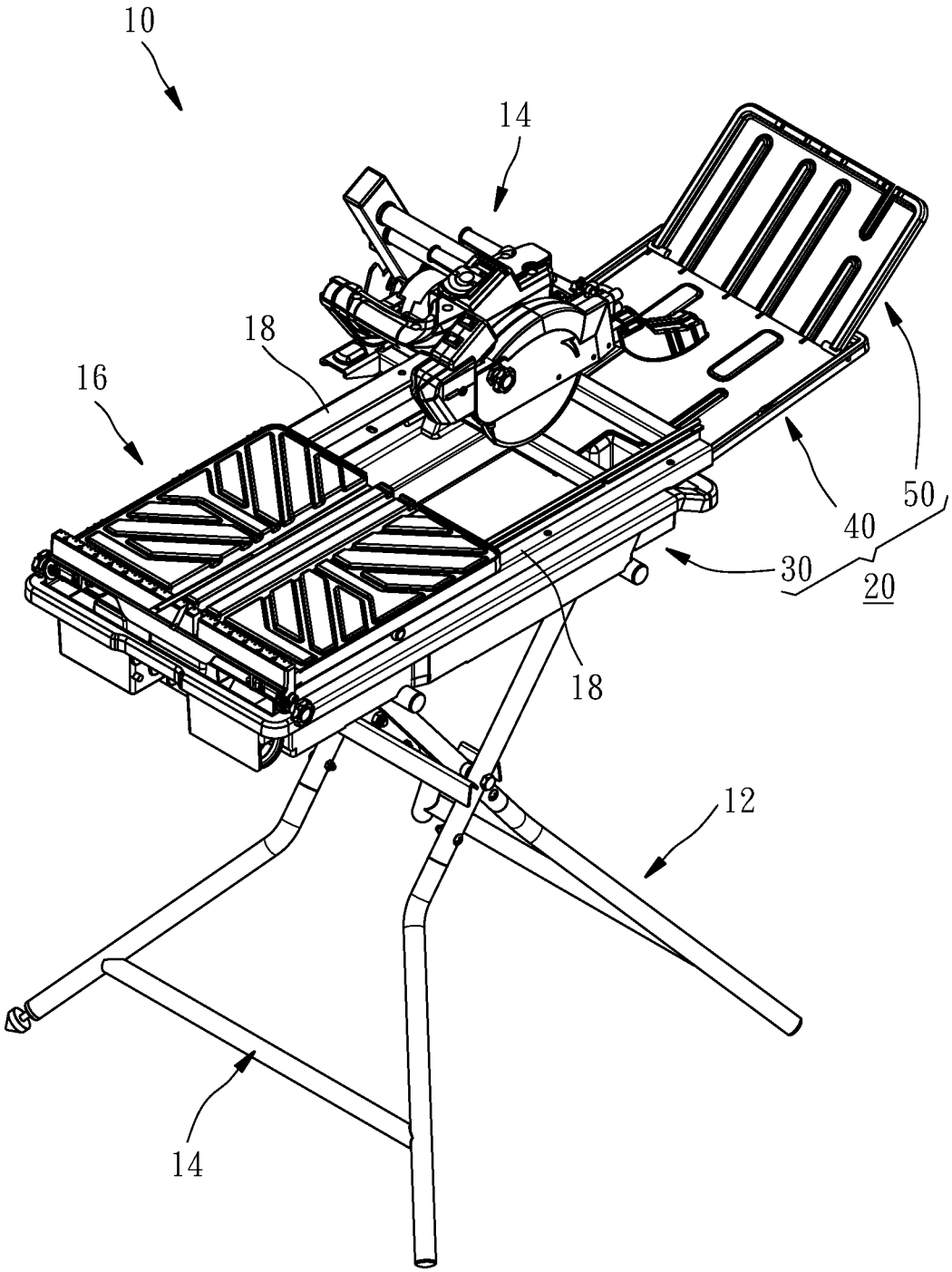
FIG. 1 is an oblique top elevational view of a tile cutter equipped with a foldable water tray in accordance with the present invention.
Figure 2:
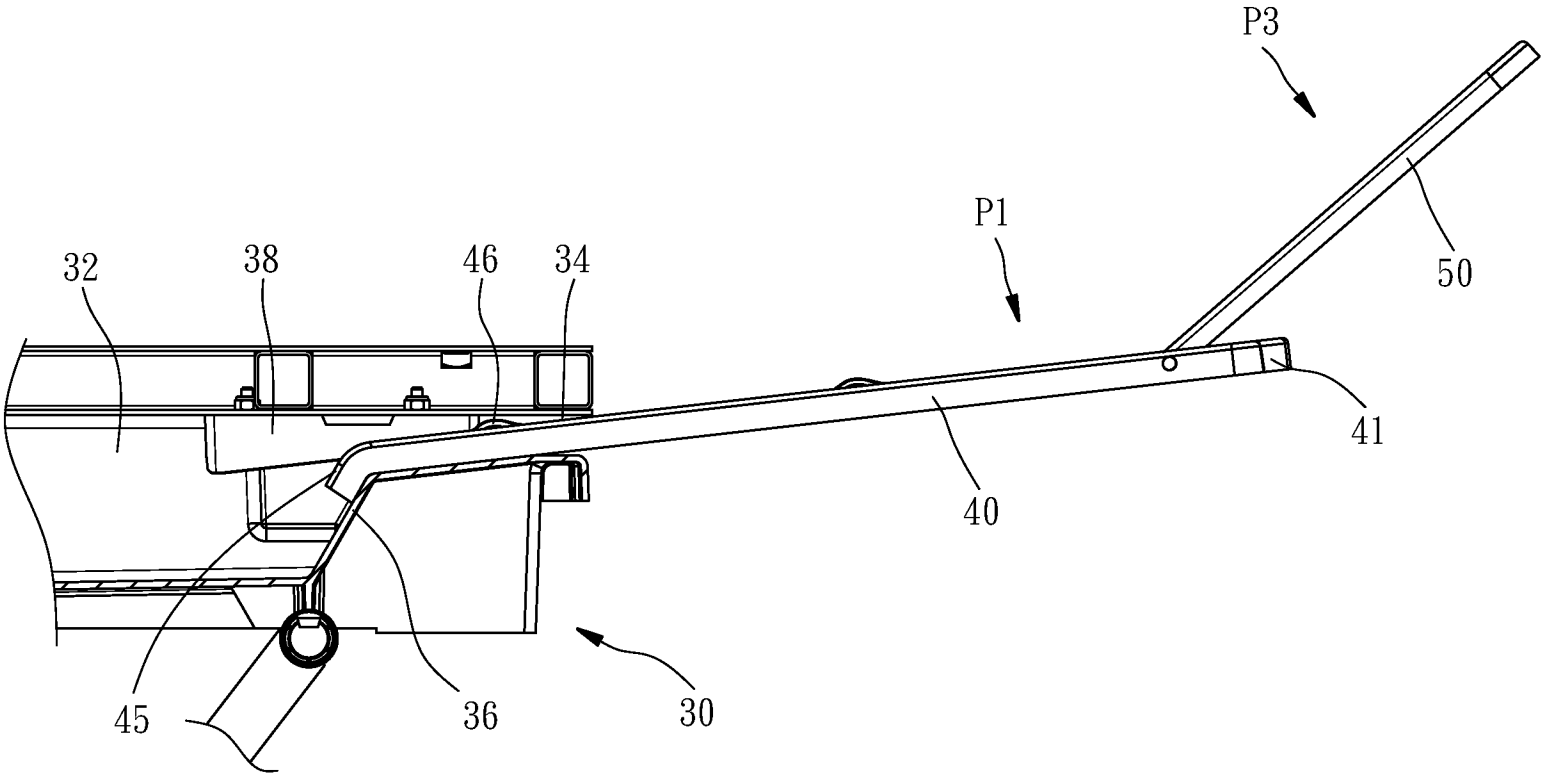
FIG. 2 is a sectional view of a part of the tile cutter shown in FIG. 1, illustrating the first tray in the application position and the second tray in the extended position.
Figure 3:
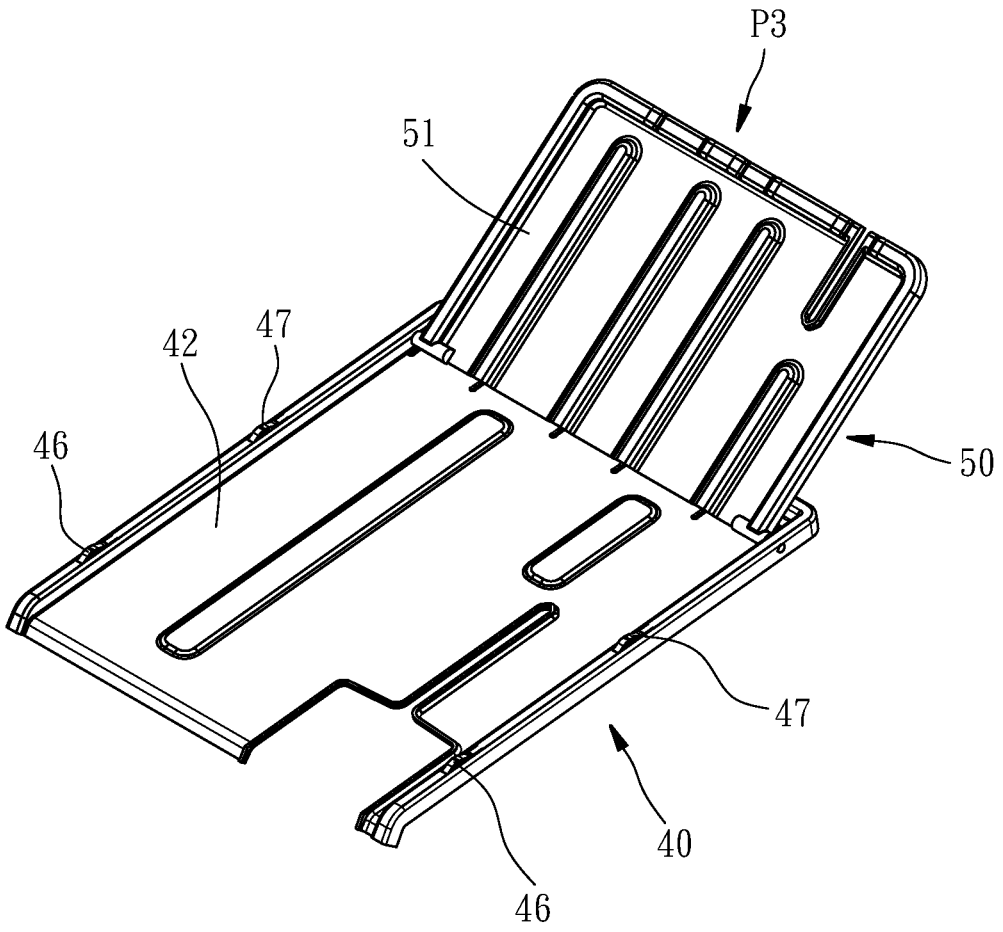
FIG. 3 is an oblique top elevational view of a part of the present invention, illustrating the first tray and the second tray coupled together.

Referring to FIG. 1, the tile cutter, referenced by 10 generally comprises a stand 12, a sawing device 14, and a worktable 16. Referring to FIGS. 2 and 3, the invention provides a foldable water tray 20 for use in the tile cutter 10. The foldable water tray 20 comprises a water tank 30, a first tray 40 and a second tray 50. The stand 12 is mounted at a bottom side of the water tank 30. The sawing device 14 is disposed at one lateral side relative to the water tank 30 above the elevation of the water tank 30. The worktable 16 is slidably mounted on two parallel rails 18 at a front side relative to the sawing device 14 so that the worktable 16 can be moved back and forth relative to the sawing device 14. Since some of the features of the tile cutter 10 is of the known art, in order to save space, some of the detailed structures and operating principle of the tile cutter 10 are not discussed in detail.

Referring to FIG. 2, the water tank 30 comprises a water chamber 32, an opening 34 located at one end thereof in communication with the water chamber 32, two first stop flanges 36 respectively located at respective top edges of two opposite inner sidewalls thereof, and two first positioning protrusions 38 respectively disposed above the first stop flanges 36.

Figure 4:
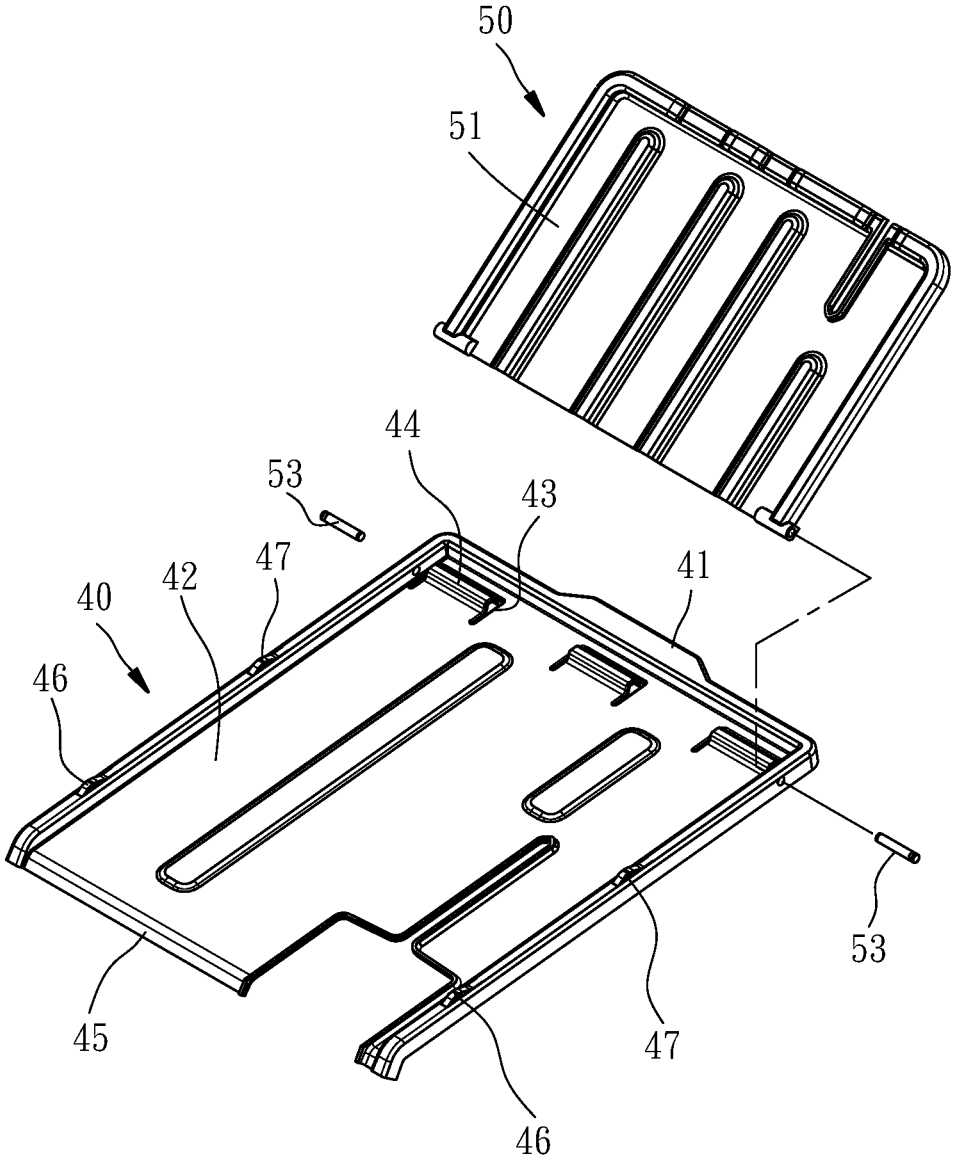
FIG. 4 is an exploded view of the assembly of FIG. 3.
Figure 8:
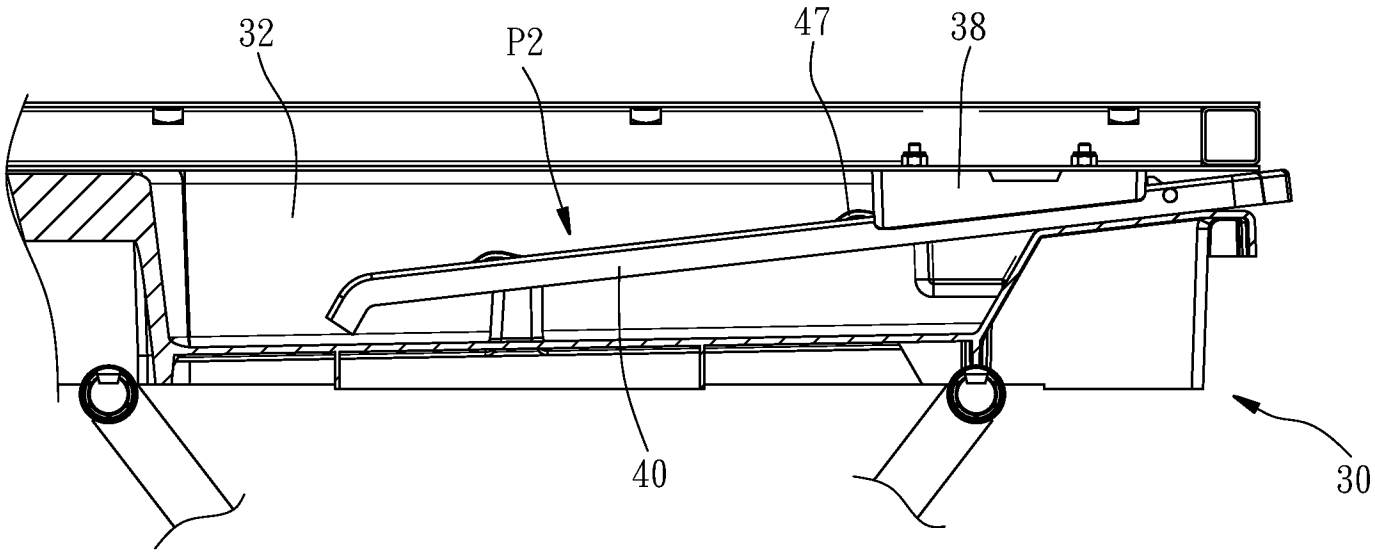
FIG. 8 is similar to FIG. 7, illustrating the first tray in the storage position.

The first tray 40 is mounted in the opening 34 of the water tank 30, and movable relative to the water tank 30 between an application position P1 outside the water chamber 32 (see FIG. 2) and a storage position P2 inside the water chamber 32 (see FIG. 8). As illustrated in FIG. 3 and FIG. 4, the first tray 40 comprises a grip 41 located at an outer end thereof for operation by the user to move the first tray 40 between the application position P1 and the storage position P2, a first water retaining surface 42 sloping downwards toward the water chamber 32 of the water tank 30 for guiding water toward the inside of the water chamber 32 of the water tank 30, three slots 43 cut through the first water retaining surface 42 and transversely arranged in line near the outer end that is equipped with the grip 41, three elastic protruding portions 44 respectively disposed to face toward the three slots 43, and a second stop flange 45 extended along one end of the first water retaining surface 42 remote from the grip 41 and curved downwards for engaging the first stop flanges 36 of the water tank 30 to hold the first tray 40 in the application position P1 shown in FIG. 2 and to prohibit separation of the first tray 40 from the water tank 30. Referring to FIG. 3 again, the first tray 40 further comprises two second positioning protrusions 46 and two third positioning protrusions 47 respectively located at two opposite lateral sides thereof. When the first tray 40 is in the application position P1 shown in FIG. 2, the second positioning portions 46 of the first tray 40 are respectively forced into engagement of the respective first positioning protrusions 38 of the water tank 30. When the first tray 40 is in the storage position P2 shown in FIG. 8, the third positioning portions 47 of the first tray 40 are respectively forced into engagement of the respective first positioning protrusions 38 of the water tank 30. Thus, the user needs to overcome the engagement force between the first positioning protrusions 38 and the second positioning portions 46 so as to further push the first tray 40 inwardly to the storage position P2. Similarly, the user needs to overcome the engagement force between the first positioning protrusions 38 and the third positioning portions 47 so as to pull the first tray 40 outwardly to the application position Pl. Subject to the design of the second positioning portions 46 and the third positioning portions 47, the first tray 40 can be held in the application position P1 or the storage position P2 positively, and will not be accidentally pulled outwards or pushed inwards. For example, in one embodiment of the invention, the protrusions 46 and 47 may have a height for passing by the first positioning protrusion 38 and/or the first positioning protrusion or the first tray 40 are flexible.

Figure 5:
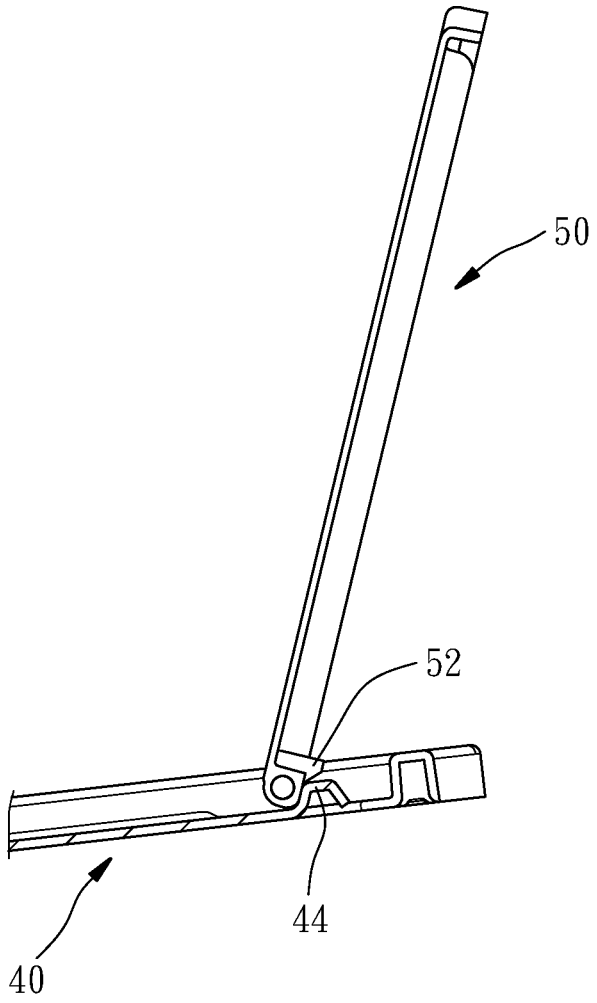
FIG. 5 is a sectional view of a part of the present invention, illustrating the bearing protrusions of the second tray abutted against the elastic protruding portions of the first tray.
Figure 6:
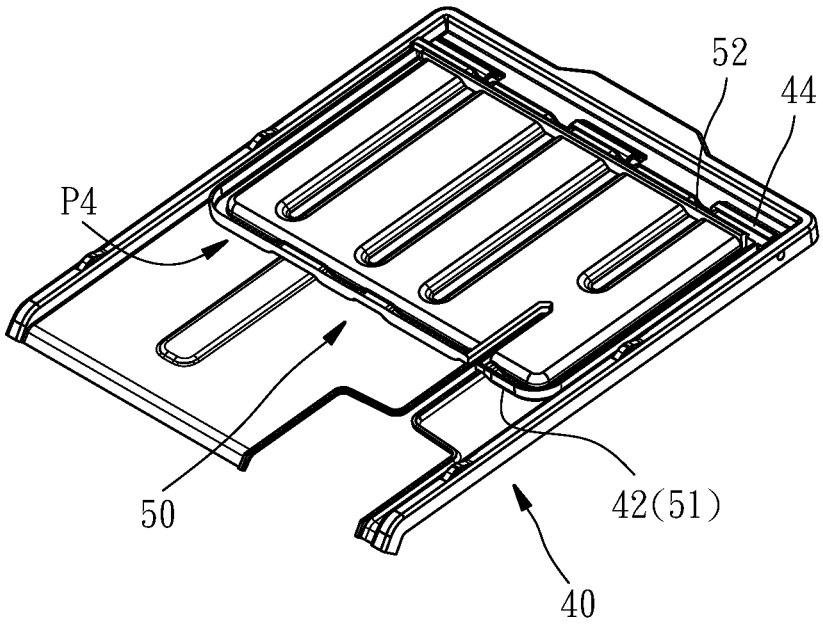
FIG. 6 is similar to FIG. 3, illustrating the second tray in the collapsed position.

The second tray 50 comprises a second water retaining surface 51, and a bearing protrusion 52 located at a bottom side thereof opposite to the second water retaining surface 51 (see FIG. 5 and FIG. 6). Further, the second tray 50 has one end thereof pivotally connected to the first tray 40 near the grip 41 by two pivot pins 53, and thus, the second tray 50 can be biased relative to the first tray 40 between an extended position P3 and a collapsed position P4. When the second tray 50 is in the extended position P3, the bearing protrusion 52 of the second tray 50 is abutted against the elastic protruding portions 44 of the first tray 40 (see FIG. 5), and thus, a predetermined contained angle (for example, between 90-175 degrees, and preferably between 120-135 degrees) is defined between the second water retaining surface 51 of the second tray 50 and the first water retaining surface 42 of the first tray 40. When the second tray 50 is in the collapsed position P4, as shown in FIG. 6, the second water retaining surface 51 of the second tray 50 covers the first water retaining surface 42 of the first tray 40, allowing the second tray 50 to be carried by the first tray 40 between the application position P1 and the storage position P2.

Figure 7:
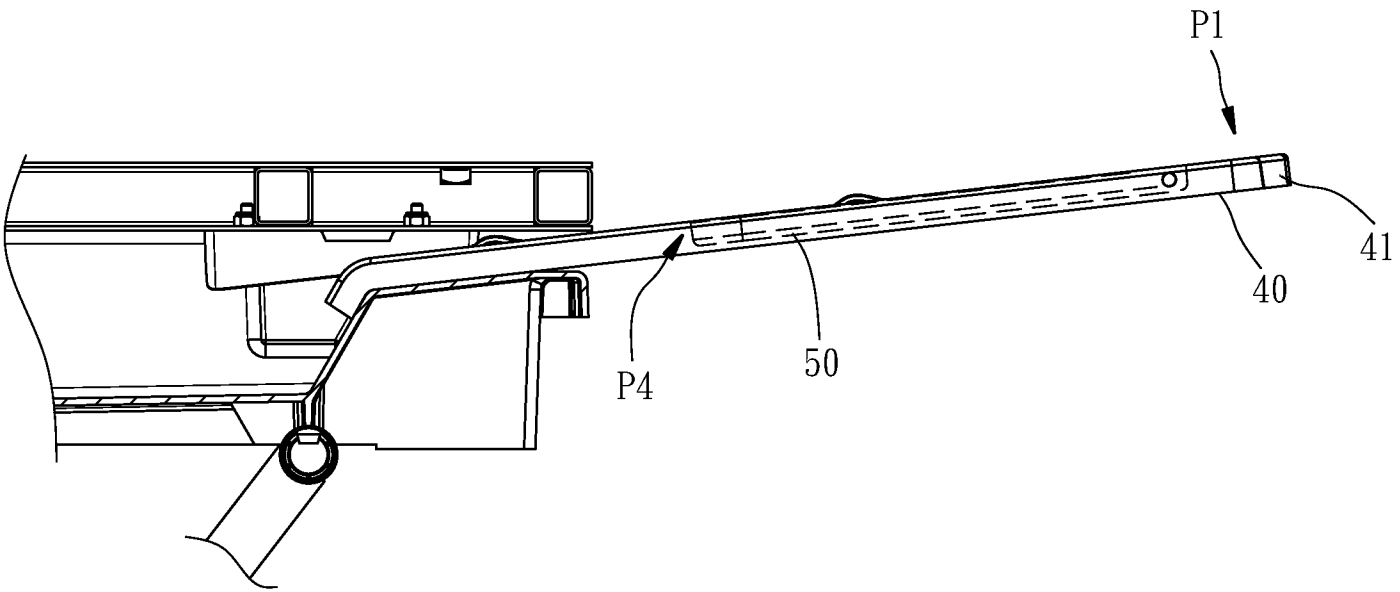
FIG. 7 is similar to FIG. 2, illustrating the first tray in the application position and the second tray in the collapsed position.

In actual operation, the grip 41 of the first tray 40 is operable to pull the first tray 40 from the storage position P2 shown in FIG. 8 to the application position P1 shown in FIG. 7, and then the second tray 50 is able to be turned upwards from the collapsed position P4 shown in FIGS. 6 and 7 to the extended position P3 shown in FIGS. 2 and 3. At this time, the user can control a water supply device (not shown) to spray water over the workpiece under the cutting operation.

In the process of spraying water over the workpiece, the first water retaining surface 42 of the first tray 40 and the second water retaining surface 51 of the second tray 50 are used to prevent or minimize water splashing from the tile cutter, as shown in FIG. 2, where the water drops that are retained by the first water retaining surface 42 of the first tray 40 can flow along the first water retaining surface 42 of the first tray 40 to the inside of the water chamber 32 of the water tank 30, and the water drops that are retained by the second water retaining surface 51 of the second tray 50 can flow along the second water retaining surface 51 of the second tray 50 to the first water retaining surface 42 of the first tray 40 and then to the inside of the water chamber 32 of the water tank 30. Thus, the water sprayed from the water supply device can be recycled and reused.

Figure 9:
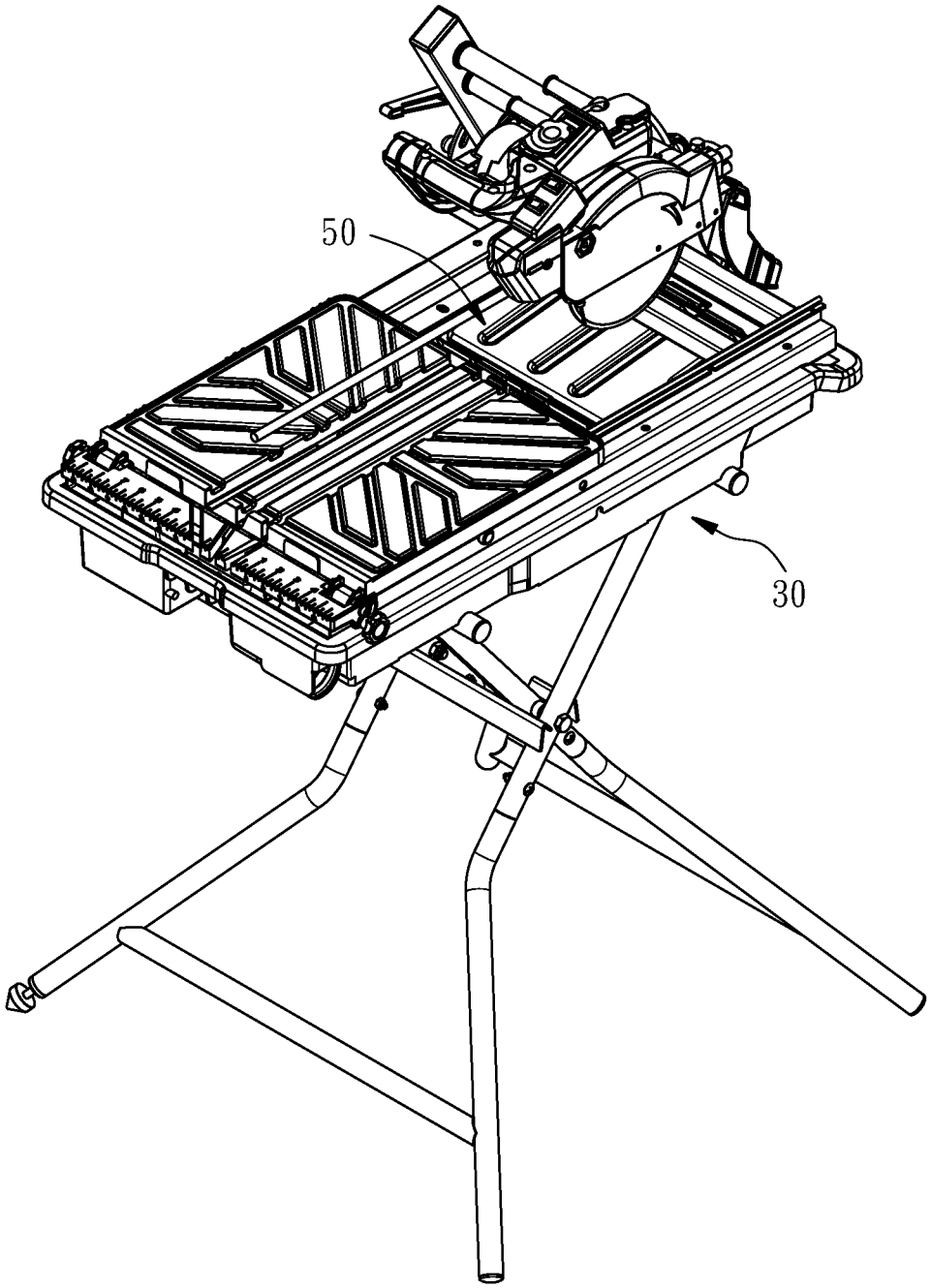
FIG. 9 is similar to FIG. 1, illustrating the first tray in the storage position.

After the water spraying process is ended, the second tray 50 is able to be turned downwardly from the extended position P3 shown in FIGS. 2 and 3 to the collapsed position P4 shown in FIGS. 6 and 7, and then the grip 41 of the first tray 40 is operable to push the first tray 40 inwardly from the application position P1 shown in FIG. 7 to the storage position P2 shown in FIG. 8, enabling the first tray 40 and the second tray 50 to be received inside the water chamber 32 of the water tank 30, as shown in FIG. 9, and thus, the first tray 40 and the second tray 50 are able to be positioned to accommodate a saving of space.

Additionally, when cutting a long workpiece that touches the second tray 50 during the cutting operation, the elastic design of the elastic protruding portions 44 of the first tray 40 can create a certain space for allowing the second tray 50 to be biased downwards so that the workpiece can be smoothly cut regardless of the interference of the second tray 50.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A foldable water tray used in a tile cutter, comprising:

a water tank comprising a water chamber;

a first tray mounted at one end of said water tank and movable relative to said water tank between an application position where said first tray is disposed outside said water chamber and a storage position where said first tray is disposed inside said water chamber, said first tray comprising a first water retaining surface; and a second tray pivotally connected to said first tray and biasable relative to said first tray between an extended position and a collapsed position, said second tray comprising a second water retaining surface, said second water retaining surface defining with said first water retaining surface of said first tray a predetermined contained angle when said second tray is disposed in said extended position, said second water retaining surface of said second tray configured to cover said first water retaining surface of said first tray when said second tray is disposed in said collapsed position.

2. The foldable water tray as claimed in claim 1, wherein said first tray further comprises at least one slot through said first water retaining surface, and at least one elastic protruding portion located at said first water retaining surface and respectively disposed to face toward said at least one slot; said second tray further comprises at least one bearing protrusion located at a bottom side thereof opposite said second water retaining surface and adapted for abutment against said at least one elastic protruding portion of said first tray to support said second tray in said extended position.

3. The foldable water tray as claimed in claim 1, wherein said water tank comprises a first stop flange located in said water chamber; said first tray further comprises a second stop flange located at one end thereof for engagement with said first stop flange of said water tank to hold said first tray in said application position.

4. The foldable water tray as claimed in claim 1, wherein said water tank further comprise two first positioning protrusions symmetrically disposed at two opposite lateral sides thereof; said first tray further comprises two second positioning protrusions and two third positioning protrusions respectively disposed at two opposite lateral sides of said first water retaining surface of said first tray, said second positioning protrusions of said first tray being adapted for engagement with said first positioning protrusions of said water tank to hold said first tray in said application position, said third positioning protrusions of said first tray being adapted for engagement with said first positioning protrusions of said water tank to hold said first tray in said storage position.

5. The foldable water tray as claimed in claim 1, wherein said first water retaining surface of said first tray slopes downwards toward said water chamber of said water tank.

* * * * *